US007674754B2

(12) United States Patent
Noble et al.

(10) Patent No.: US 7,674,754 B2
(45) Date of Patent: Mar. 9, 2010

(54) WATER-BASED METALWORKING FLUID INCORPORATING POLYMERIC BORON MATERIALS

(75) Inventors: John Noble, Carmel, IN (US); Philip B. Simon, Ann Arbor, MI (US); Ross Smith, Columbus, IN (US)

(73) Assignee: Masco Corporation, Taylor, MI (US)

( * ) Notice: Subject to any disclaimer, the term of this patent is extended or adjusted under 35 U.S.C. 154(b) by 501 days.

(21) Appl. No.: 11/564,442

(22) Filed: Nov. 29, 2006

(65) Prior Publication Data

US 2007/0179067 A1 Aug. 2, 2007

Related U.S. Application Data

(60) Provisional application No. 60/741,205, filed on Dec. 1, 2005.

(51) Int. Cl.
*C10M 155/04* (2006.01)
*C10M 173/02* (2006.01)
*C10M 157/10* (2006.01)

(52) U.S. Cl. ..... 508/189; 508/188; 508/206; 508/280; 508/562; 508/579; 72/42

(58) Field of Classification Search ..... 508/189, 508/150, 151, 545
See application file for complete search history.

(56) References Cited

U.S. PATENT DOCUMENTS

| | | | | |
|---|---|---|---|---|
| 2,809,171 | A | 10/1957 | Vernon et al. | |
| 3,101,369 | A | 8/1963 | Brotherton | |
| 3,489,528 | A | 1/1970 | Zanieski et al. | |
| 4,578,283 | A | 3/1986 | Kirtley et al. | |
| 4,581,468 | A | 4/1986 | Paciorek et al. | |
| 4,801,439 | A | 1/1989 | Blum et al. | |
| 5,859,124 | A * | 1/1999 | Yorifuji et al. | 524/837 |
| 6,103,178 | A | 8/2000 | Bujalski et al. | |
| 6,277,348 | B1 | 8/2001 | Pujol et al. | |
| 7,125,499 | B2 | 10/2006 | Ferguson et al. | |
| 2005/0096235 | A1 * | 5/2005 | McCullough et al. | 508/250 |

FOREIGN PATENT DOCUMENTS

WO WO 03016433 2/2003

OTHER PUBLICATIONS

Masami Inoue et al.; Borazine-Siloxane Organic/Inorganic Hybrid Polymer; Advanced Study Center Co. Ltd; Rev.Adv.Mater.Sci. 5 (2003) pp. 392-397.

* cited by examiner

*Primary Examiner*—Glenn A Caldarola
*Assistant Examiner*—Taiwo Oladapo
(74) *Attorney, Agent, or Firm*—Gifford, Krass, Sprinkle, Anderson & Citkowski, P.C.

(57) ABSTRACT

A water-based metalworking fluid is comprised of a polymeric boron species which includes at least B, N and H, together with a surfactant operable to provide an emulsion of the boron species with water. The polymeric boron species may be a polyborane or a borazine polymer and may be configured as a polyborane or borazine polymer backbone having side chains pendent thereupon. The side chains may include silicon and/or phosphorous. The silicon may be in the form of a silane or a siloxane species, including polymeric species. Disclosed are specific compositions as well as methods for using the compositions and methods for making the compositions.

18 Claims, No Drawings

WATER-BASED METALWORKING FLUID INCORPORATING POLYMERIC BORON MATERIALS

CROSS-REFERENCE TO RELATED APPLICATIONS

This application claims priority of U.S. Provisional Patent Application Ser. No. 60/741,205 filed Dec. 1, 2005, entitled "Water-Based Metalworking fluid Incorporating Polymeric Boron Materials."

FIELD OF THE INVENTION

This invention relates generally to metalworking fluids. More specifically, the invention relates to water-based, recyclable metalworking fluids which incorporate boron-based polymers as well as to methods for making such compositions, and their use in metalworking processes.

BACKGROUND OF THE INVENTION

Metalworking fluids are employed in metalworking operations such as cutting, forming, stamping and rolling to provide cooling and lubrication to both the workpiece and the metalworking apparatus. The metalworking fluids also function to flush away oil and debris from the worksite and they provide corrosion protection to both the workpiece and the metalworking apparatus. Metalworking fluids were initially formulated from hydrocarbon oils and solvents. However, water-based metalworking fluids are coming to be widely used.

Water-based metalworking formulations typically comprise emulsified structures incorporating both water-soluble and water-insoluble materials in a stable, emulsified composition. Water-based metalworking fluids are more environmentally acceptable than are hydrocarbon oil-based fluids. Water-based fluids can be easily recycled, and waste handling and pollution control is minimized when such fluids are utilized. Problems do occur with water-based fluids, however, since such fluids may have lower lubricity than do oil-based fluids. Furthermore, various additive packages incorporated in water-based fluids are subject to depletion in the use of the fluids. Often, the depletion of the various components of the fluid does not proceed at the same rate, and it is frequently difficult to monitor the compositional state of the fluids.

As will be explained hereinbelow, the present invention provides for a class of water-based metalworking fluids which incorporate boron-based inorganic polymers. These boron-based polymers are very stable and hence are not prone to break down during use and storage of the compositions; hence, the compositions are stable and can be readily recycled and replenished. In addition, such materials can provide a high degree of lubricity to water-based compositions.

BRIEF DESCRIPTION OF THE INVENTION

Disclosed is a metalworking fluid which comprises a polymeric boron species which includes at least B, N and H, together with water and a surfactant in an amount operable to provide an emulsion of the polymeric boron species and the water. In some instances, the polymeric boron species comprises a polyborane or a borazine polymer. In particular instances, the polymeric boron species comprises a backbone of a polyborane or a borazine polymer having side chains pendent thereupon. The side chains may include silicon and/or phosphorous and, in particular instances, at least some of the side chains comprise a halogenated alkyl silane. In other instances, at least some of the side chains include a siloxane polymer which is optionally halogenated. In a specific instance, the siloxane polymer side chain is a linear polydimethyl siloxane. Other polymeric boron species may comprise polyaminoboranes or polyiminoboranes. In particular instances, the polymeric boron species has a liquid crystal structure.

In some instances, the fluid may further include one or more of an alkanolamine, a polyol surfactant, a glycol ether, a polyglycol surfactant, or a corrosion inhibitor. In particular instances, the fluid may further include a fluoroalkyl silane.

Also disclosed are some specific compositions in accord with the foregoing, as well as methods for using the composition and methods for making the composition.

DETAILED DESCRIPTION OF THE PREFERRED EMBODIMENTS

The present invention is directed to a novel class of metalworking fluids comprised of water-based compositions which incorporate polymeric boron materials therein. A number of polymeric boron materials are known in the art, and these materials typically comprise boron, nitrogen and hydrogen. One such group of materials are polyboranes, and specific members of this group are polyaminoboranes as well as polyiminoboranes. Borazine polymers are another group of such materials known in the art. These polymeric boron materials are stable, inert, and water insoluble. They are resistant to bacterial degradation, chemical breakdown and are stable under high temperature, high pressure conditions such as are encountered in metalworking processes. Depending upon the degree of polymerization, compositions with various viscosities can be prepared from these polymeric materials, and in many instances, such materials have a high degree of lubricity.

In some instances, the polymeric boron materials may be configured as a backbone comprised of the boron polymer, further including pendent side chains such as silicon or phosphorus-based side chains. Materials of this type are shown in U.S. Pat. No. 4,581,468 which describes borazine polymers having side chains based upon silicon or other materials. A similar disclosure is found in U.S. Pat. No. 6,103,178. A particular group of boron-based polymeric materials having very good lubricating properties are disclosed in U.S. Pat. No. 7,125,499, which is incorporated herein by reference. This particular group of materials has specific silicon and/or phosphorus-based side chains and has a particular liquid crystal structure. These materials can have very high lubricity and the prior art recognizes their utility in metalworking applications.

However, the prior art has not heretofore recognized the possibility of, or advantages of utilizing polymeric boron species in water-based metalworking fluids. In fact, while the aforementioned U.S. Pat. No. 7,125,499 patent specifically teaches the use of boron polymer compositions as lubricants or cutting fluids in metalworking operations, it does not teach or suggest that such polymers can be incorporated into water-based metalworking fluids. In fact, all teaching therein is of the water immiscibility of the disclosed compounds, and as such suggests their incompatibility with aqueous-based compositions.

As will be explained in further detail hereinbelow, the present invention recognizes that polymeric boron materials may be successfully incorporated into water-based metalworking fluids so as to form stabilized emulsions. It is to be understood within the context of this disclosure that the term "emulsion" is to be interpreted broadly to encompass compositions of water and water-soluble materials with water-insoluble boron polymers, which compositions are homogenized or otherwise stabilized to produce a macroscopically homogeneous fluid structure which is stable during its intended period of use. Such structures may be characterized as oil-in-water or water-in-oil, and may include various micellar structures, lamellar structures, simple emulsions, complex emulsions, and various intermediate dispersions of the mutually insoluble materials.

One particular group of compositions is comprised of a mixture of one or more surfactants, such as a polyol and/or polyglycol surfactants, together with an alkanolamine, the boron polymer, and a biocide, which may comprise a single biocidal material or a combination of biocides. The composition typically also includes a corrosion inhibitor package which may also comprise a single corrosion inhibitor or a mixture of corrosion inhibitors. The foregoing ingredients are mixed with water for use. In some instances, the composition may be provided as a concentrate which is subsequently diluted for use. Materials of this type provide very good lubricity and cooling in metalworking operations. In addition, they function very well to sequester and remove contaminants, including oils, from metalworking apparatus and workpieces. The compositions are stable in use and resistant to biological contamination. The compositions are free of hazardous material such as phenols, cresols and the like, and they can be fabricated to be free of fatty acids which can react with certain metals and form unwanted soapy deposits. The compositions are compatible with a wide variety of metals including ferrous and nonferrous metals, and it is a notable feature of the present invention that the compositions can be formulated so as to be non-corrosive toward copper, zinc or lead, and hence are very useful in the machining of brass.

Fluoroalkyl silanes such as fluoropropyl silanes can further enhance the performance of water-based, boron polymer-containing metalworking fluids. The presence of the fluoroalkyl silane enhances the water washability of the metalworking fluid, which is significant since it facilitates cleaning the metalworking fluid from the finished parts. The presence of the fluoroalkyl silane also enhances the high pressure lubricity of the compositions. Thus, fluoroalkyl silanes are beneficial adjuncts in boron-based polymer-containing metalworking fluids. The fluoroalkyl silane component may be a discrete molecular species in the formulation, or it may comprise a pendent group on the boron polymer, and such materials are described hereinbelow. In either instance, the beneficial effects of the fluoroalkyl silane will be realized.

In specific embodiments, the metalworking fluid comprises, on a weight basis, 1-10% of the boron material, 1-15% of an alkanolamine, and 0.1-10% of a surfactant. In those instances where corrosion inhibitors are included they may be present in an amount of 10-30%, and biocides, when included, are typically present in an amount of 0.5-1.0%. The composition may also include ancillary ingredients such as anti-foam agents, coloring agents and the like. The remainder of the composition is water.

The metalworking fluids may also include an alkanolamine. There are a number of alkanolamines which may be used either singly or in combination in the compositions. Preferred alkanolamines are generally C1-C4 alkanolamines, and primary, secondary and tertiary alkanolamines may all be employed. One specific group of alkanolamines comprises isopropanolamines. Other alkanolamines include ethanolamines. The alkanolamines may be used either singly or in combination, and generally comprise 1-15%, and in certain embodiments 13-15% of the composition.

The metalworking fluid can include a polyol surfactant. It has been found that this group of surfactants provides superior sequestering performance and facilitates the removal of oils and other such hydrophobic materials from the workpiece and machinery. One polyol having utility in the compositions comprises a poly(oxy-1,2-ethanediyl), alpha-(4-nonylphenyl)-omega-hydroxy-, branched material. Such polyols are available from the Superior Chemical Corporation of Indianapolis, Ind., under the designation Superwet 9.5. Other surfactants having utility are polyglycols. One such polyglycol surfactant comprises a block copolymer of polyoxypropylene and polyoxyethylene. Surfactants of this type are commercially available from a number of sources, and one specific material comprises the product sold under the designation Pluronic 17R2. This material is available from The BASF Corporation. Other such surfactants include P-41-300 sold by the Hoescht Celanese Corporation, and Triton EF-14 sold by Rohm and Haas. Yet other materials will be apparent to those of skill in the art.

The boron-based polymer, in one group of embodiments, comprises a liquid crystal boron polymer of the type disclosed in U.S. Pat. No. 7,125,499, the disclosure of which is incorporated herein by reference. Such materials are of the general formulae: $—(B—H—N—R—BH—NR'—)_n$; $(—BH_2—NHR—BH—NR'—)_n$; and

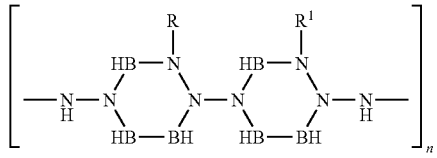

where n is in the range of about 1-130, and R and R' are linear polydimethyl siloxane polymers (including halogenated siloxane polymers). In certain instances, n is approximately 70. In other instances, the R and R' may comprise hydrocarbon-based moieties such as organic acids, esters, alcohols and the like. In yet other instances, the chains R and R' may comprise biocidal moieties, anticorrosion agents or other active species.

The metalworking fluid may include a biocide which can be a single material or a mixture of materials having a biocidal effect against both bacteria and fungi. One preferred biocide comprises a morpholine compound. One preferred morpholine biocidal compound comprises 4-(2-nitrobutyl)morpholine. Other morpholine materials include 4,4'-(2-ethyl-2-nitrotrimethylene)dimorpholine and methylene dimorpholine. Biocidal morpholine mixtures are available from the Angus Chemical Company of Buffalo Grove, Ill. under the designation Bioban P-1487 and Bioban CS-1135. The material sold by Rohm and Haas under the designation Kaython EDC 1.5 may also be used in this regard. This material comprises poly(oxy-1,2-ethanediyl(dimethylimino)-1,2-ethanediyl (dimethylimino)-1,2-ethanediyl dichloride). Equivalent compositions are sold under the designation Bioban TS by Angus Chemical Company, and the aforementioned Kaython EDC 1.5. Other compositional ranges of these materials, as well as other combinations of materials, are also useful in the practice of the present invention.

The compositions can also include a corrosion inhibitor. The specific corrosion inhibitor employed will depend, to some degree, upon the nature of the metals with which the material is being employed. One class of compounds having utility as corrosion inhibitors comprise thiazoles, and one specific thiazole material is sodium 2-mercaptobenzothiazole. Such material is available from the Lubrizol Corporation of Wickliffe, Ohio in a formulation sold under the designation Aqualox. Yet another corrosion inhibitor which may be used in these formulations comprises a boramide such as the product sold under the designation Addco CP-B-2 by the Lubrizol Corporation. Other corrosion inhibitors include the materials sold by Lubrizol Corporation under the designation Alox. Typically, the corrosion inhibitor will be present in an amount of about 10-30%, and in specific embodiments in a range of 8-10%.

In addition to the foregoing, the metalworking fluids of the present invention may include other active components. One material often employed in the metalworking fluid compositions comprises diethylene glycol monobutyl ether. This material is often referred to the in art as glycol ether DB, and is typically present in an amount of approximately 0.5-2%. Other ingredients in the compositions may include isoalkyloxy amine oxide. This material may be present in an amount of approximately 10-12%. Additionally, amounts of benzotriazole, either in the form of the free base or as salts, may also be added to the compositions.

The metalworking fluids may also include ancillary ingredients such as coloring agents, fragrances, viscosity or rheology control agents, defoamers, scents and the like.

Various compositions may be prepared in accord with the teaching presented herein. One specific group of compositions is as follows:

| CAS# | Ingredient | Percent by Weight |
|---|---|---|
| 7732-18-5 | Water | 22-59 |
| 000078-96-6 | Monoisopropanolamine | 1-3 |
| 0000110-97-4 | Diisopropanolamine | 4-7 |
| 0000122-20-3 | Triisopropanolamine | 4-7 |
| Proprietary | Amine Oxide (Tomah AO-455) | 12-18 |
| Proprietary | Aqualox 232 | 8-12 |
| Proprietary | Addco CP-B-2 | 4-8 |
| Proprietary | Boron Polymer | 4-8 |
| 015217-42-2 | Benzotriazole | 2-5 |
| 000112-34-5 | Glycol Ether DB | 1-3 |
| EPA# 48301-7 | Bioban P-1487 | 0.25-2.5 |
| 071662-44-7 | Polyether Phosphate | 0.1-1.0 |
| Proprietary | Foam Ban HP-710 | 0.1-1.0 |
| 127087-87-0 | Poly(oxy-1,2-ethanediyl), Alpha-(4-nonylphenyl)-omega-hydroxy-, branched | 0.1-1.0 |
| 67762-90-7 | Silicone Compound | 0.1-1.0 |

Yet other compositions may be implemented in accord with the teaching presented herein. Modifications of the foregoing composition may be prepared, for example, by adding 1.25-1.75% of glycol ether DB to the mixture. Relatively small amounts of an anti-foaming agent, such as a polysiloxane defoamer, may be added to the composition. Typically, defoamers are employed in approximately 0.05-0.25%. Yet other compositions may be implemented in accord with the teachings presented herein.

It has been found that the foregoing compositions function very well as metalworking fluids for cutting or otherwise shaping a wide variety of materials including leaded brass. The compositions provide a high degree of lubricity even under high-pressure conditions, and thus are compatible with high volume, high speed metalworking systems. The fluids are stable against biological contamination, and do not form metallic soap deposits. They readily clean and sequester oils and are non-corrosive to brass. The service life of the materials is long, and they may be readily recycled. In that regard, spent fluid may be collected and filtered to remove impurities and debris. Oils and other contaminants may be removed by skimming and/or filtering, and the resultant fluid reused in the metalworking process. In some instances, the recycled fluid will have certain of its components replenished before reuse. The boron polymer may be readily reclaimed from the spent fluid by breaking the emulsion and separating the boron phase. The extreme non-reactivity of the boron fluids facilitates their separation and purification.

Various other formulations may be prepared in accord with the present invention. While the foregoing has primarily described compositions based upon a specific group of liquid crystal, boron-based polymer fluids, a variety of other boron-based polymer materials are known in the art and such materials may likewise be utilized in the practice of the present invention. The foregoing is illustrative of specific embodiments of the invention, but is not meant to be a limitation upon the practice thereof. It is the following claims, including all equivalents, which define the scope of the invention.

The invention claimed is:

1. An emulsified metalworking fluid comprising:

a polymeric boron species which includes at least B, N, and H, wherein said polymeric boron species comprises a backbone of a polyborane or polyborazine polymer having side chains pendent thereupon, and wherein said side chains include silicon and/or phosphorus and wherein at least some of said side chains comprise a halogenated alkyl silane;

water; and a surfactant in an amount sufficient to provide an emulsion of said polymeric boron species and said water.

2. The fluid of claim 1, said fluid further including at least one member selected from the group consisting of: an alkanolamine, a polyol surfactant, a glycol ether, a polyglycol surfactant, a biocide, and a corrosion inhibitor.

3. The fluid of claim 1, further including a fluoroalkyl silane.

4. The fluid of claim 1, further including an isoalkyloxy amine oxide.

5. The fluid of claim 1, further including a beazotriazole.

6. The fluid of claim 1, wherein said surfactant comprises a polyoxypropylene-polyoxyethylene block copolymer.

7. An emulsified, water-based metalworking fluid comprising, on a weight basis:

1-15% of an alkanolamine;

0.1-5% of a polyol surfactant;

1-10% of a boron material selected from the group consisting of: polyaminoboranes, polyiminoboranes, borazine polymers, and combinations thereof;

10-30% of a corrosion inhibitor;

0.5-1.0% of a biocide; and the remainder water, wherein said water and said boron material are emulsified.

8. A method for shaping a metal workpiece, said method including the steps of:

providing an emulsified metalworking fluid comprising: a polymeric boron species which includes at least B, N and H; water; and a surfactant in an amount sufficient to provide an emulsion of said polymeric boron species and said water;

shaping a metal workpiece; and contacting said workpiece with said fluid.

9. An emulsified metalworking fluid comprising:

a polymeric boron species which includes at least B, N and H;

water; and a polyoxypropylene-polyoxyethylene block copolymer surfactant in an amount sufficient to provide an emulsion of said polymeric boron species and said water.

10. The metalworking fluid of claim 9, wherein said polymeric boron species comprises a polyborane or a borazine polymer.

11. The fluid of claim 9, wherein said polymeric boron species comprises a backbone of a polyborane or a borazine polymer having side chains pendent thereupon.

12. The fluid of claim 11, wherein said side chains include silicon and/or phosphorus.

13. The fluid of claim 12, wherein at least some of said side chains comprise a halogenated alkyl silane.

14. The fluid of claim 12, wherein at least some of said side chains include a siloxane polymer, which is optionally halogenated.

15. The fluid of claim 14, wherein said siloxane polymer is a linear polydimethyl siloxane.

16. The fluid of claim 9, wherein said polymeric boron species comprises a polyaminoborane, or a polyiminoborane.

17. The fluid of claim 9, wherein said polymeric boron species has a liquid crystal structure.

18. An emulsified metalworking fluid comprising:

a polymeric boron species which includes at least B, N and H;

water; and a surfactant in an amount sufficient to provide an emulsion of said polymeric boron species and said water;

wherein said composition includes at least one member selected from the group consisting of: an alkanolamine, a polyol surfactant, a glycol ether, a polyglycol surfactant, a biocide, a corrosion inhibitor, a fluoroalkyl silane, an isoalkyloxy amine oxide, and benzotriazole.

* * * * *